US005269846A

United States Patent [19]

Eskelinen et al.

[11] Patent Number: 5,269,846

[45] Date of Patent: Dec. 14, 1993

[54] DEFLECTION-COMPENSATED DOCTOR BLADE BEAM

[75] Inventors: Juhani Eskelinen, Helsinki; Risto Mäkinen, Järvenpää; Markku Järvensivu, Valkeakoski, all of Finland

[73] Assignee: Valmet Paper Machinery Incorporated, Helsinki, Finland

[21] Appl. No.: 804,952

[22] Filed: Dec. 11, 1991

[30] Foreign Application Priority Data

Dec. 13, 1990 [FI] Finland ..... 906133

[51] Int. Cl.[5] ..... B05C 11/04

[52] U.S. Cl. ..... 118/100; 118/123; 118/101; 118/126; 118/413; 162/281

[58] Field of Search ..... 118/101, 123, 126, 413, 118/419, 665, 100; 15/256.5, 256.51; 162/281; 427/356

[56] References Cited

U.S. PATENT DOCUMENTS

| | | | |
|---|---|---|---|
| 3,134,126 | 5/1964 | Phillips | 118/101 |
| 3,245,378 | 4/1966 | Caple et al. | 118/126 |
| 4,092,916 | 6/1978 | Link et al. | 162/281 |
| 4,097,528 | 3/1990 | Sollinger | 118/126 |
| 5,005,515 | 4/1991 | Sollinger | 118/413 |
| 5,032,229 | 7/1991 | Boucher | 162/281 |

FOREIGN PATENT DOCUMENTS 2222968 3/1990 United Kingdom .

*Primary Examiner*—W. Gary Jones
*Assistant Examiner*—Steven P. Griffin
*Attorney, Agent, or Firm*—Cohen, Pontani, Lieberman, Pavane

[57] ABSTRACT

A deflection-compensated doctor blade beam of a coater used for coating web materials. The doctor blade beam comprises a box-section frame (3), together with a holder (2) of the doctor blade (8), and a support tube (4) placed inside the frame (3). The support tube (4) is backed against the frame (3) preferably with three asymmetrically placed compensating elements (5), which advantageously are pressurized hoses. The deflection of the doctor blade beam is accomplished by varying the volume of the compensating elements (5) through pressure alterations in the elements. A displacement of desired direction can be achieved by differentially pressurizing the three compensating elements (5). By using this apparatus, the deflection of the doctor blade can be compensated to full straightness. The compensating system is controlled with the help of a feedback loop using data from a direct measurement of beam deflection, or alternatively, from the coat thickness profile. The straightness of the beam can be controlled on the basis of measurement this data either automatically or manually.

8 Claims, 2 Drawing Sheets

DEFLECTION-COMPENSATED DOCTOR BLADE BEAM

FIELD OF THE INVENTION

The present invention relates to coating web-like material with a doctor blade beam, the deflection of which can be compensated.

BACKGROUND OF THE INVENTION

Paper and similar web-like material are coated by applying a coating mix onto the web surface which is then spread into an even layer using a doctor blade. In the coater, the web to be coated passes through a gap formed between the doctor blade and a suitable backing member, conventionally a rotating roll. The blade doctors or removes excess coating from the web surface and levels the coating mix into an even layer on the web surface. To achieve a layer with as even a thickness as possible, the gap formed between the web and the doctor blade should have as constant as possible a spacing in the cross direction of the web over its entire width. The linear force applied to press the doctor blade against the web should be high and constant over the entire width of the blade to attain an even spreading of the coating mix onto the web even at high web speeds.

For several reasons, the gap between the material web and the doctor blade cannot be maintained exactly constant along the width of the doctor blade. During machining, the doctor blade and its frame are fixed to the machining unit base with strong fixtures into a position that simulates their operating positions. Despite exact placement of the fixtures on the machining unit, defects will develop during fabrication of the doctor blade and its frame, thereby causing an error in the parallel alignment between the web surface and the doctor blade tip. Also, as the doctor blade of the coater is pressed against the moving web, a linear force is applied to the blade. Due to the pivotal support of the doctor blade frame provided by bearings mounted at both ends of the frame, the deflection induced by the linear force is greater at the center of the blade than at its supported ends. As a result, the spacing between the blade tip and the web is less at the edges of the web than at its center. Additionally, since the linear force exerted by the blade onto the surface of the web or the backing roll is less at the center than at the supported ends, any possible bumps on the web, as well as variations in the density and viscosity of the coating mix, can lift the blade tip away from the web.

To alleviate the aforementioned disadvantages, several different designs for the attachment of the doctor blade have been presented in the prior art. For example, a homogeneous loading of the blade over the entire web width has been attempted by means of a flexible blade combined with an adjustable blade holder assembly. In this example, the blade is attached to the blade holder so that the blade can be pressed against the web by means of a resilient element, for example, a pneumatically or hydraulically loaded rubber hose, which extends across the entire length of the blade. Because of the equal pressure prevailing in the hose along its entire length, the hose presses the blade against the web with a constant linear force over the entire width of the web. The blade pressure against the web can then be adjusted by altering the pressure in the hose. In this design, a doctor blade is occasionally used which is divided into narrow sections along its width. The advantage of this approach is a more flexible blade that offers an improved conformance with the shape of the web and the backing roll.

The above-described design has several disadvantages. Because of the limited deformation capability of the resilient loading element, this design is incapable of compensating for large variations in the spacing between the blade and the web, or for loading of the blade. The adjustment range of blade loading remains restricted, and, if a higher coating speed is desired, the blade must be pressed against the web with an actuator element attached to the doctor blade. A higher blade loading results in an increased stiffness of the blade holder element so that the blade becomes incapable of conforming to the web surface in a desired manner. Also, the frame of the doctor blade must be extremely stiff so that it can compress the flexible blade against the web.

Flexible and adjustable doctor blade holder constructions are complicated, blade changes are awkward, and damage to the pressure-exerting elements may result during blade changes. Consequently, the blade holder construction becomes large and heavy.

Calenders use deflection-compensated rolls having a load-bearing basic roll in the center of the roll. Pressure-exerting elements are placed between the basic roll and the shell of the roll so that when the shape of the elements is changed, the roll shell is straightened. A deflection compensated doctor blade beam based on a similar construction is described in U.S. Pat. No. 4,907,528 where the doctor blade beam has four pressure-exerting elements symmetrically positioned about a round frame beam and enclosed by a tubular shell which itself is supported to the square frame of the doctor blade assembly. By adjusting the operating pressure of the pressure-exerting elements, the frame of the doctor blade assembly can be deformed appropriately to compensate for the deflection of the doctor blade beam of the coater.

G.B. Patent No. 1,202,167 describes a similar doctor blade beam supported by a square coater frame containing an inner tube with a square box section. Between the inner tube and the coater frame are mounted pressure-exerting elements, which are attached on the two opposing sides of the coater frame. Thus, the beam deflection can be compensated in the direction of one bending axis by altering the pressure prevailing in the pressure-exerting elements.

However, the beam construction described in U.S. Pat. No. 4,907,528 is complicated, thereby resulting in a considerably high weight. As a result, the inherent weight of the beam additionally contributes to its deflection, thus requiring more powerful means of compensation. Furthermore, the shape of the beam is not freely selectable by the designer because the frame of the coater must necessarily have a square shape and because there must necessarily be four pressure-exerting elements. The tube connecting the pressure-exerting elements is joined to the coater frame by means of gliding shoe members, and, due to this supporting method, the coater frame and the gliding shoe members must be machined with great accuracy and have smooth gliding surfaces. Therefore, the construction becomes extremely expensive. Furthermore, the friction associated with a gliding support complicates the doctor blade beam compensation, and moreover, contributes to increased wear in such a construction.

The construction described in G.B. Patent No. 1,202,167 is relatively simple, but it is only capable of compensating the beam deflection in one bending axis.

SUMMARY OF THE INVENTION

It is an object of the present invention to achieve a novel type of deflection-compensated doctor blade beam.

According to the present invention, a support tube is positioned within a doctor blade beam, and is backed against the inner walls of the box-section doctor blade beam with a number of pressure-exerting elements. Preferably, the number of pressure-exerting elements is odd and at least three.

The present invention provides a number of outstanding benefits and provided a doctor blade beam construction in which the doctor blade remains parallel to the web and the backing roll even at high linear loads of the blade. The coating speed can be increased while still attaining a high-quality coat with several different kinds of coating mixes. The linear load of the blade is kept constant over the entire length of the blade. Due to the constant loading of the blade, its wear is even over the entire blade length which contributes to an increased blade life. The compensation system disclosed herein does not cause an unacceptable increase in the weight of the blade beam. Deflection compensation in a blade beam of lightweight construction is easier than for a heavy beam because the contribution to deflection by the weight of the beam remains smaller. The present compensation system is a simple design that is easy to implement in the beam since the shape of the beam and its tubular support beam can be selected relatively freely.

During the coating process of the web, the compensation system is controlled by measuring the straightness of the beam or, alternatively, the coat thickness profile across the coated web. Because the direction of deflection, caused by each pressure-exerting element, varies in known way, the measured deflection can preferably be compensated for automatically by controlling the compensation system using a feedback loop; alternatively, the operator of the coater can manually control the compensation system. The connections between the support tube, the pressure-exerting elements, and the frame of the doctor blade beam are frictionless. Therefore, the surface of the frame of the doctor blade beam need not be smooth. The frictionless operation of the pressure-exerting elements can optionally be assured by greasing them during assembly and maintenance sessions. The pressure-exerting elements also contribute to vibration damping of the doctor blade beam.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DESCRIPTION OF THE PRESENTLY PREFERRED EMBODIMENTS

Figure 1:
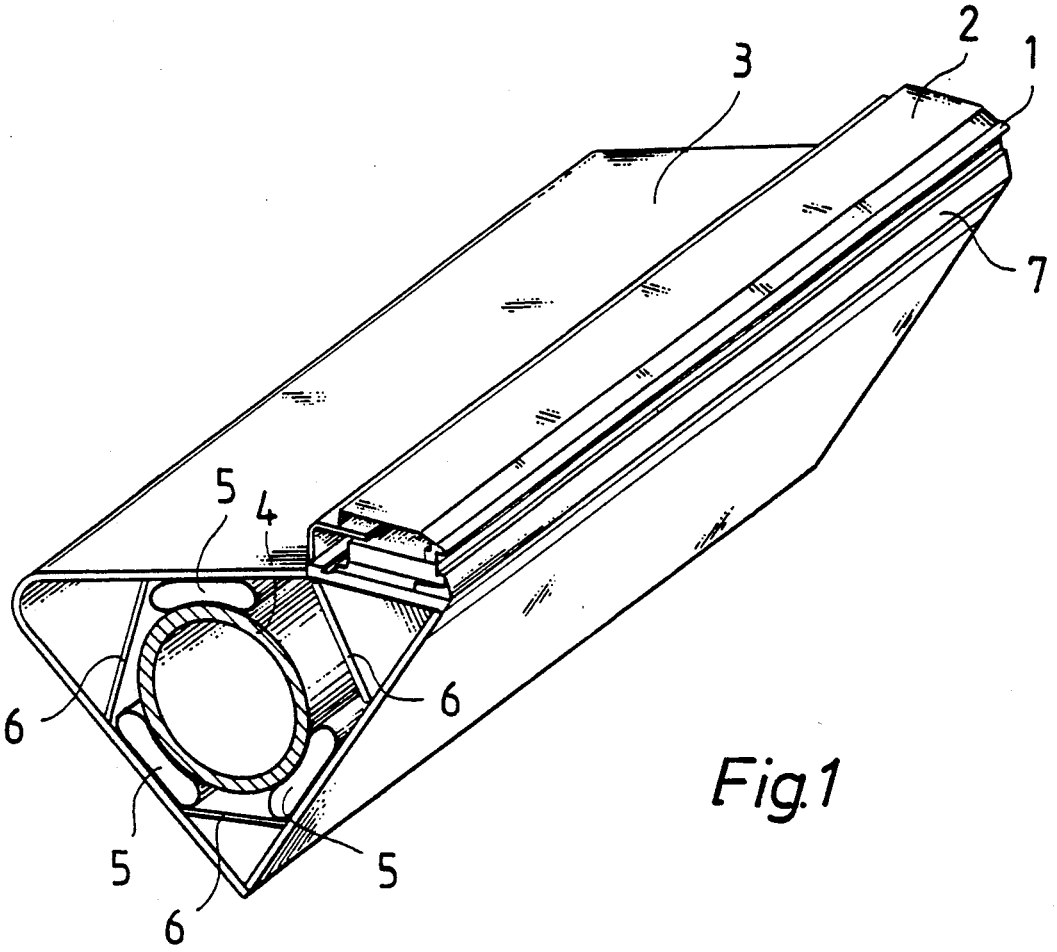
FIG. 1 is a cross-sectional perspective view of a doctor blade beam according to the present invention.
Figure 2:
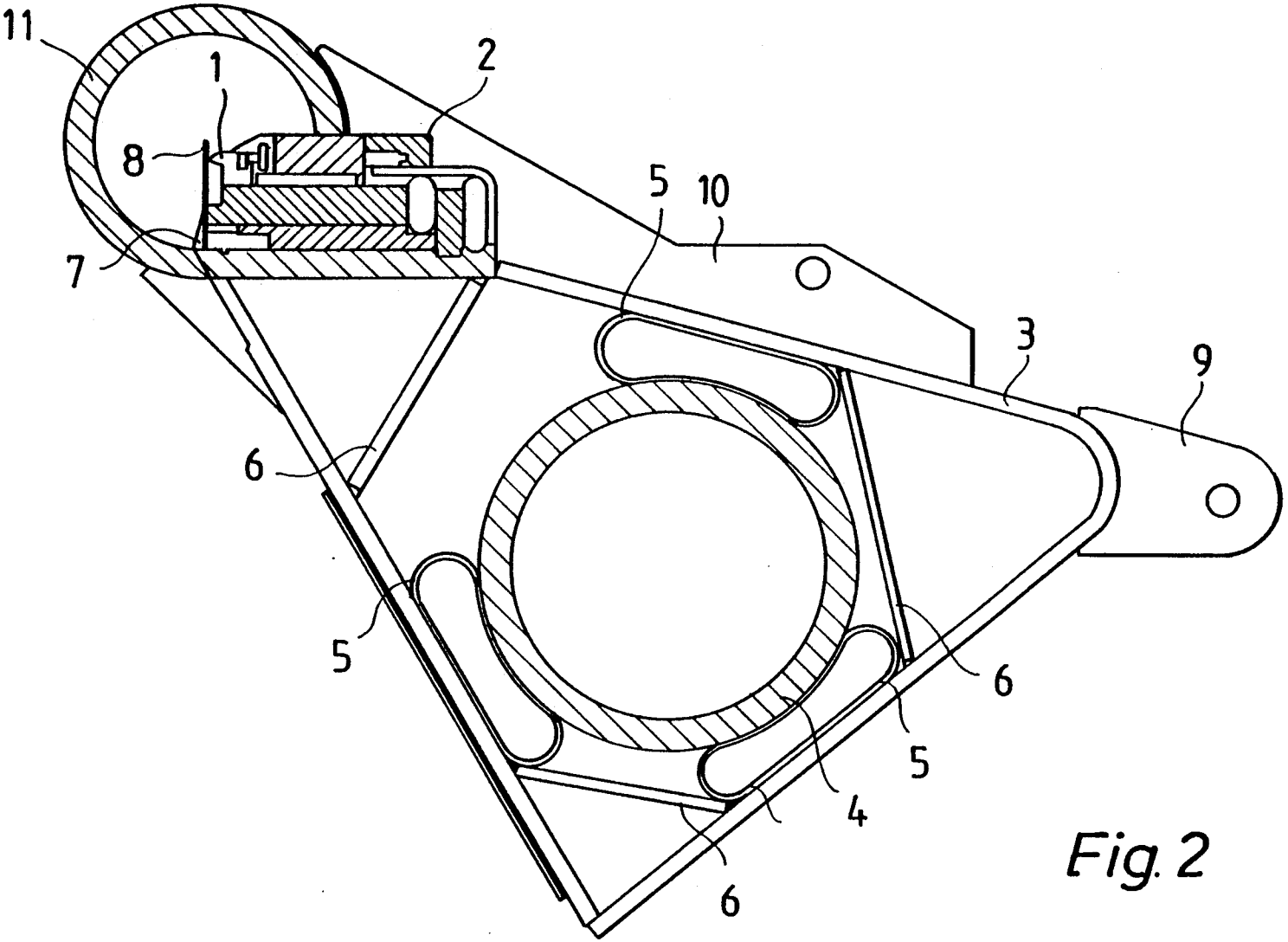
FIG. 2 is a detailed cross-sectional view of a doctor blade beam according to the present invention.

Referring to FIGS. 1 and 2, the doctor blade beam according to the present invention comprises a triangular box-section frame 3 with support walls 6 at the corners of the triangular frame 3, a blade holder 2 attached to one corner of the triangular frame 3, a support tube 4, and compensating elements 5. Attached to the front edge of the blade holder 2 are a fixing member 7 and a support member 1 of the blade 8. The blade 8 is not shown in FIG. 1, but, as shown in FIG. 2, is attached at its lower edge to the fixing member 7. The blade 8 is pressed against the web to be coated by means of the support member 1 at a suitable distance from the tip of the blade 8. Different versions of doctor blade holders are known to those of ordinary skill in the art and may alternatively be used in conjunction with the doctor blade beam structure of the present invention. The doctor blade beam is pivotally attached to its support in a bearing 11 and fixture elements 9 and 10. The support tube 4 is connected by joints equipped with bearings to the ends of the frame 3 of the beam. Such support methods are known to those of ordinary skill in the art.

The compensation system is comprised of the support tube 4 and three compensating elements 5 adapted asymmetrically about the support tube 4. The compensating elements 5 are adapted about the cylindrical support tube 4 in that their mutual spacings along the perimeter of the tube 4 are not equal. This arrangement brings about asymmetrical backing of the support tube 4 against the inner walls of the frame 3 of the doctor blade beam. One side of each compensating element 5 rests against the inner wall of the frame 3 of the blade beam while the other side of each compensating element 5 is compressed against the convex side of the support tube 4. The compensation elements 5 are preferably high-pressure hoses filled with pressurized liquid.

The compensation of blade deflection is attained by altering the liquid pressure in the each of the pressurized hoses 5 in a suitable manner for the function of each hose 5. Increasing the pressure in one hose 5 expands its diameter, thereby increasing the distance between the frame 3 of the doctor blade beam and the support tube 4 at this hose. At the same time, pressure in the two hoses 5 on the opposite side of the support tube is decreased to allow the frame 3 of the doctor blade beam to correspondingly move closer to the support tube 4 on this side. Three pressurized hoses 5 are preferably sufficient to attain desired displacements in three directions in the cross-sectional plane of the doctor blade beam. The combined effect of these displacements make it possible to create deviations in the cross-sectional plane of the beam. The volumes of the pressurized hoses 5 are altered appropriately such as, for example, by increasing the volume of two hoses with high pressure, while the volume of the third hose 5 is decreased by lowering its pressure, resulting in a desired amount of compensating displacement. The asymmetric supporting scheme facilitates attainment of all desired displacements, because one force must always be opposed by two forces of different action. In a symmetrical case, the magnitudes of the forces in the three compensating elements 5 are equal. In an alternative embodiment where the number of compensating elements 5 is even, the pairs of opposing compensating elements 5 exert their effect pairwise on the frame 3 and support tube 4 of the beam.

Pressure in all pressurized hoses 5 must be controlled and altered simultaneously to achieve only the desired displacements necessary for compensating for the beam deflections without causing unnecessary extra stresses on the structures. The simultaneous control scheme makes it possible to readily shift the frame 3 of the doctor blade beam in a desired manner with respect to the support tube 4. The pressure in the pressurized hoses 5 causing the desired displacements is most appropriately controlled automatically by a feedback loop by directly measuring the deflection of the beam using a conventional method. Alternatively, automatic control can be achieved by measuring the coat weight profile, since the straightness of the blade 8 can be extrapolated from variations in the coat weight profile. The control algorithm is derived from the directions of the displacements caused by each of the compensating elements 5, after which a desired opposing displacement can be effected by altering the pressure in the compensating elements 5 using a feedback loop which uses data from a direct measurement of beam deflection, or, alternatively, from the coat thickness profile.

The pressure in the pressurized hoses 5 is adjusted with an appropriate hydraulic circuit (not shown). The hydraulic circuit of each pressurized hose can be designed to dampen pressure oscillations in the hydraulic circuit using conventional methods. Oscillations in the circuit arise mainly from the vibrations of the support frame 3 and doctor blade beam during the operation of the coater. Additional vibrations are also transmitted to the frame of the blade support and therefrom further to the blade beam from vibrations emitted from other elements used in the paper manufacturing process, such as, for example, the backing roll. Consequently, the vibration-damping hydraulic circuit with its pressurized hoses 5 operates as an effective hydraulic isolator which reduces the vibrations of doctoe blade beam.

Thus, while there have been shown and described and pointed out fundamental novel features of the invention as applied to a preferred embodiment thereof, it will be understood that various omissions and substitutions and changes in the form and details of the disclosed apparatus, and in its operation, may be made by those skilled in the art without departing from the spirit of the invention. It is the invention, therefore, to be limited only as indicated by the scope of the claims appended hereto.

For example, the compensating elements 5 can be other types of deformable elements such as hydraulic cylinders. The pressurized medium can be a desired type of gas, liquid or any other fluid medium such as air, water, oils or fats. The pressurized medium can be heated or cooled so that the compensating effect is amplified by altering the differential temperature of the blade beam. The number and placement of the compensating elements 5 can be varied. For example, the compensating elements 5 can be designed to extend over the entire length of the beam, or, alternatively, over only a shorter section of the beam. A compensating element 5 extending over the entire length of the beam may be comprised of several sections. Instead of three compensating elements 5, each cross section of the beam can incorporate a greater number of the compensating elements 5, preferably so that their number is uneven. The shape of the frame 3 and the support tube 5 can be varied. Similarly, the support walls 6 and other structures placed within the frame 3 of the beam can be shaped and dimensioned differently. Alternatively, support walls 6 may be eliminated entirely, provided that the structure of triangular frame 3 is sufficiently strong. Alternatively, the support walls 6 can be formed so as to support the compensating elements 5 from their sides. The cross section of the support tube 4 can, alternatively, be triangular or even any other desired asymmetrical shape. In addition, compensating elements 5 may be symmetrically disposed about the circumference of support tube 4.

What is claimed is:

1. A deflection-compensated doctor blade beam for use in a coater which applies a coat of material across a web, comprising:

a substantially triangular cross-section box-section frame having a central core with three inner surfaces;

a blade holder fixedly attached to said box-section frame;

a doctor blade fixedly mounted to said blade holder;

a support tube disposed within said central core of said frame having an outer surface; and three compensating elements disposed within said central core of said frame about said support tube and directly against said outer surface of said support tube and each of said three inner surfaces of said central core, said compensating elements being deformable in shape upon application to said compensating elements of a pressurized medium.

2. The deflection-compensated doctor blade beam of claim 1, comprising a number of compensating elements having a multiple of three.

3. The deflection-compensated doctor blade beam of claim 1, wherein at least one of said compensating elements has a length substantially equal to that of said support tube.

4. The deflection-compensated doctor blade beam of claim 1, wherein at least one of said compensating elements has a length less than that of said support tube.

5. The deflection-compensated doctor blade beam of claim 1, wherein said compensating elements are disposed asymmetrically about said support tube.

6. The deflection-compensated doctor blade beam of claim 1, further comprising temperature varying means for varying the temperature of said pressurized medium applied to at least one of said compensating elements for varying the temperature of said at least one of said compensating elements.

7. The deflection-compensated doctor blade beam of claim 1, wherein said support tube is circular in cross section.

8. The deflection-compensated doctor blade beam of claim 1, wherein said support tube is triangular in cross section.

* * * * *